United States Patent [19]

Davidson et al.

[11] 4,259,422

[45] Mar. 31, 1981

[54] ELECTROGRAPHIC PROCESS FOR MAKING TRANSPARENCIES

[75] Inventors: Bruce W. Davidson; Frederick A. Pomeroy, both of Rochester; M. Akram Sandhu, Pittsford, all of N.Y.

[73] Assignee: Eastman Kodak Company, Rochester, N.Y.

[21] Appl. No.: 959,828

[22] Filed: Nov. 13, 1978

Related U.S. Application Data

[63] Continuation-in-part of Ser. No. 900,966, Apr. 28, 1978, abandoned.

[51] Int. Cl.[3] ..... G03C 5/00; G03G 13/22

[52] U.S. Cl. ..... 430/17; 430/126

[58] Field of Search ..... 427/22, 24, 194, 195, 427/197, 407 G, 414; 96/1.4; 428/475.2, 478.2; 430/17, 126, 47

[56] References Cited

U.S. PATENT DOCUMENTS

| | | | |
|---|---|---|---|
| 2,843,499 | 7/1958 | Andrus | 427/24 |
| 2,995,085 | 8/1961 | Walkup | 96/1.4 |
| 3,549,360 | 12/1970 | O'Neill et al. | 427/24 |
| 3,600,210 | 8/1971 | Haycock | 427/24 |
| 3,758,327 | 9/1973 | York et al. | 96/1.4 |
| 3,854,942 | 12/1974 | Akman | 96/1.4 |

FOREIGN PATENT DOCUMENTS

| | | | |
|---|---|---|---|
| 730526 | 10/1974 | Netherlands | 427/407 G |

*Primary Examiner*—Morris Kaplan
*Attorney, Agent, or Firm*—J. L. Tucker

[57] ABSTRACT

A transparency that is used to project an image onto a viewing surface such as a screen is prepared by an electrographic copying process. An element used in this process comprises a transparent support that is coated with an image-receiving hydrophilic colloid layer that receives an image pattern of fusible toner particles. The image pattern of toner particles is fused to the hydrophilic colloid layer by contacting the toned image-bearing layer with a heated fuser surface such as a fuser roll. The fuser surface is coated with a release liquid which inhibits offsetting of the toner particles onto the fuser surface.

Transparencies prepared by this process exhibit good resistance to abrasion in toned areas while also displaying substantially no release liquid in non-toned areas upon projection viewing. Furthermore, toned areas of such transparencies can be selectively removed by light rubbing with a moist cloth or tissue.

22 Claims, No Drawings

ELECTROGRAPHIC PROCESS FOR MAKING TRANSPARENCIES

This is a continuation-in-part of application Ser. No. 900,966, filed Apr. 28, 1978, now abandoned.

BACKGROUND OF THE INVENTION

1. Field of the Invention

This invention relates to the preparation of projection-viewable transparencies by an electrographic copy process. In one aspect, this invention relates to an electrographic copy process in which an image pattern of fusible toner particles is fused onto an image-receiving hydrophilic colloid layer of a transparent receiver element by contacting the element with a heated fusing surface coated with a release liquid that prevents undesirable transfer of toner particles to the fuser surface. In another aspect, this invention relates to projection-viewable transparencies that are formed in such process.

2. Description of the Prior Art

It has been known for many years that the projection of an image present upon a transparency may serve as an effective means for conveying information to one or more observers. Such transparencies can be formed by a number of methods, a common one being transfer electrostatic copying. By this process, an image of fusible toner particles is formed on a receiving layer of a transparent element. The particles are then fixed to the element by contact with a heated fusing surface such as a roller which is coated with a release liquid to inhibit transfer or "offsetting" of toner particles from the element onto the fusing surface.

Prior art transparencies are composed of a transparent film support and an insulating receiving layer on one or both sides of the support for receiving the toner particles. Typical receiving layers are hydrophobic layers formed from a wide variety of materials including polyamides (U.S. Pat. No. 3,535,112, issued Oct. 20, 1970 to T. J. Dolce et al.); vinylidene chloride copolymers (U.S. Pat. No. 3,539,340, issued Nov. 10, 1970 to T. J. Dolce et al.); poly(vinyl butyral); poly(bisphenol A carbonate); polystyrene; polyesters of terephthalic acid, ethylene glycol and 2,2-bis[4-($\beta$-hydroxyethoxy)-phenyl]propane; poly(vinyl formal); vinyl chloride-acrylonitrile copolymers; vinyl chloride-vinyl acetate copolymers; poly{4,4'-(2-norbornylidene)diphenylene carbonate} (British Pat. No. 1,237,386, published June 30, 1971 in the name of Eastman Kodak Company); poly(ethyl methacrylate); mixed acrylic polymers containing methyl and butyl methacrylate, butyl acrylate and a small amount of either a carboxylate salt or melamine-formaldehyde material. Prior art transparencies that are prepared according to the aforementioned copy process may also have receiving layers that are provided with surfactants, wetting agents and the like which are capable of rendering the receiving surface hydrophilic. Typical examples of such transparencies are tinted Arkwright PPC Transparency Films (Arkwright, Inc., Fiskeville, R.I., 02823) and those disclosed in U.S. Pat. No. 3,549,360 (issued Dec. 22, 1970 to A. J. O'Neill et al.).

As will be apparent from the discussion hereinafter, a transparency formed by an electrographic process should have certain characteristics to render it particularly useful in conveying information to one or more observers. For example, substantially clear non-toned areas, resistance to abrasion in toned areas and ability to selectively remove information by simply rubbing with a damp cloth or tissue are characterisitics of considerable importance. The importance of substantially clear non-toned areas in a transparency is apparent. Resistance to abrasion in toned areas is needed so that a transparency can withstand conventional handling conditions without damage to and loss of information in toned areas. The ability to selectively remove information from a transparency is important in order to illustrate particular points of interest to a viewing audience and to provide flexibility in using such a transparency. In this regard, removing such information by simply rubbing with a damp cloth or tissue, as described herein, is convenient and avoids possible damage to a transparency which can occur when such information is removed by scraping. It is also desirable to prepare a transparency having the aforementioned combination of characteristics using an electrographic process that can be operated over a wide range of processing conditions. Thus, it is important to be able to prepare such a transparency without being unduly limited to the specific toner fusion temperatures of a particular commercial electrographic copier.

Unfortunately, the state of the prior art has not advanced sufficiently to the point where a transparency having the aforementioned combination of properties can be prepared in an electrographic process using a wide range of conditions. Thus, we have observed that prior art transparencies having a surfactant coated on the image-receiving layer perform quite differently at different toner fusion temperatures. For example, at temperatures of about 340° F. (171° C.) such transparencies exhibit low resistance to abrasion in toned areas. At temperatures of about 375° F. (191° C.) the same transparency is more resistant to abrasion in toned areas, but exhibits undesirable haze in non-toned areas. Furthermore, regardless of the toner fusion temperature employed, toned areas of such transparencies cannot be removed by light rubbing with a wet cloth or tissue. Moreover, we have also observed with prior art transparencies having receiving layers composed of hydrophobic materials such as polyethylene terephthalate, that release liquid employed during fusion accumulates in irregular patterns on the receiving layer. This release liquid appears as an unsightly stain in non-toned areas when the transparency is projection viewed. In addition, the toned areas in such transparencies cannot be removed with a wet cloth or tissue.

SUMMARY OF THE INVENTION

The present invention provides a novel electrographic copy process for preparing a projection-viewable transparency having a very desirable combination of characteristics. This transparency displays substantially no release liquid in non-toned areas upon projection viewing. It also has toned areas that can be selectively removed by light rubbing with a damp cloth. Furthermore, as illustrated by Example 2, such toned areas exhibit good resistance to abrasion so as to withstand normal handling conditions. In practicing this process, a toned image of fusible toner particles is formed on a hydrophilic colloid layer of a substantially transparent image-receiving element. Subsequently, the particles are fused to the hydrophilic colloid layer by contacting the layer with a heated fuser surface coated with a release liquid that inhibits transfer of the toner particles onto the fuser surface.

DETAILED DESCRIPTION OF THE PREFERRED EMBODIMENTS

The hydrophilic colloid image-receiving layers employed in the practice of this invention comprise one or more hydrophilic colloids. Suitable hydrophilic colloids can be chosen from among a wide variety of known materials. These materials include proteinaceous hydrophilic colloids such as gelatin or a gelatin derivative such as carboxymethylated gelatin. However, proteinaceous hydrophilic colloids other than gelatin are also useful. Examples of such colloids include soybean protein, casein, edestin, glutin, blood albumin, egg albumin, castor bean protein and globulin, and others as described, for example, in U.S. Pat. No. 2,852,382 issued Sept. 16, 1958 or U.S. Pat. No. 3,011,890 issued Dec. 5, 1961. Typical synthetic hydrophilic colloids that can be employed in the practice of this invention include polyvinyl compounds such as polyvinyl alcohol or a hydrolyzed polyvinyl acetate as described in U.S. Pat. No. 2,286,215; a far hydrolyzed cellulose ester such as cellulose acetate hydrolyzed to an acetyl content of 19–25% as described in U.S. Pat. No. 2,322,085; a polyacrylamide or an imidized polyacrylamide as described in U.S. Pat. No. 2,563,791; a vinyl alcohol polymer containing urethane carboxylic acid groups of the type described in U.S. Pat. No. 2,768,154, or containing cyano-acetyl groups such as the vinyl alcohol-vinyl cyanoacetate copolymer as described in U.S. Pat. No. 2,808,331; and a water-soluble polyacrylamide as described in U.S. Pat. No. 3,536,491 issued Oct. 27, 1970. Other suitable hydrophilic colloids include the materials generally employed in the preparation of photographic silver halide emulsions as binding materials or vehicles. Specific examples include water soluble polymers such as polysaccharides, e.g., dextran, as disclosed in U.S. Pat. No. 3,063,838, issued July 10, 1962; vinyl polymers; e.g., poly-N-vinyl pyrrolidones, as disclosed in U.S. Pat. No. 3,043,697, issued July 10, 1962; polyvinyl alcohol derivative, e.g., acid derivatives such as succinoylated polyvinyl alcohol, as disclosed in Minsk and Abel U.S. Pat. No. 3,165,412 issued Jan. 12, 1965; cellulose derivative, e.g., hydroxyethyl cellulose, as disclosed in Illingsworth and Minsk U.S. Pat. No. 3,003,878, issued Oct. 10, 1961, and like compounds.

The hydrophilicity of the image-receiving layers employed in the practice of this invention is an indication of an attraction of the hydrophilic colloid layer for water. This is conveniently determined by measuring the receding water contact angle, $\theta_R$, established between a droplet of distilled water on the surface of a specific layer. Methods for determining $\theta_R$ are well known, a suitable method being the Sessile drop method described in *Physical Chemistry of Surfaces* by Arthur W. Adamson (Interscience Publishing Corp., 1967, pages 352–375). Generally, hydrophilic colloid image-receiving layers used in our invention have a receding water contact angle $\theta_R$, according to the Sessile drop method, which is less than about 20°. Often such layers have a $\theta_R$ in the range from about 0° to 6°.

The image-receiving hydrophilic colloid layers described herein are typically coated on transparent supports to form image-receiver elements useful in the practice of this invention. Many suitable supports are known and such supports are often transparent polymeric film materials. Such polymeric materials include, for example, polyesters; polyacrylates such as polymethyl-and polyethylmethacrylate; and polysulfones. It is, of course, desirable that such materials have a sufficiently high glass transition temperature or softening temperature to withstand distortion during thermal fusing of toner particles as described above. Such supports can comprise linear condensation polymers which have glass transition temperatures above about 190° C., preferably above about 220° C., such as polycarbonates, polycarboxylic esters, polyamides, polysulfonamides, polyethers, polyimides, polysulfonates and copolymer variants, as illustrated by Hamb U.S. Pat. Nos. 3,634,089 and 3,772,405 and Hamb et al U.S. Pat. Nos. 3,725,070 and 3,793,249; Wilson *Research Disclosure,* Vol. 118, February 1974, Item 11833, and Vol. 120, April 1974, Item 12046; Conklin *Research Disclosure,* Vol. 120, April 1974, Item 12012; *Product Licensing Index,* Vol. 92, December 1971, Items 9205 and 9207; *Research Disclosure,* Vol. 101, September 1972, Items 10119 and 10148; *Research Disclosure,* Vol 106, February 1973, Item 10613; *Research Disclosure,* Vol. 117, January 1974, Item 11709, and *Research Disclosure,* Vol. 134, June 1975, Item 13455. A particularly useful film material is poly(ethylene terephthalate) that has been biaxially stretched, heatset and heat-relaxed. Other useful support materials include polycarbonates and polyesters containing the hexahydro-4,7-methanoindan-5-ylidenediphenylene group as disclosed, for example, in U.S. Pat. Nos. 3,317,466 and 3,856,526 and in *Research Disclosure,* Vol. 135, July 1976, Item 13568.

The hydrophilic colloid layer can be adhered to an appropriate transparent support by any suitable technique. For example, an adhesion-promoting sublayer can be applied to the support and thereafter the hydrophilic colloid layer applied over the sublayer. Suitable sublayers comprise vinylidene chloride copolymers as described, for example, in U.S. Pat. No. 2,943,937 (issued July 5, 1960 to G. F. Nadeau et al.) and U.S. Pat. No. 3,437,484 (issued Apr. 8, 1969 to G. F. Nadeau). Particularly good results are obtained with subbing layers comprising copolymers of vinylidene chloride, itaconic acid and methyl acrylate or copolymers of acrylonitrile, vinylidene chloride and acrylic acid.

In practicing our invention it is often desirable to make multiple transparencies at high speed. In such instances, it is very desirable to coat the surface of the support opposite the hydrophilic colloid layer with a transparent resinous slip coating which lowers the coefficient of friction between adjacent transparencies in a stack and insures single feeding of the transparencies. As an alternative to applying a slip coat, an antistatic layer can be applied to the surface of the support opposite the image-receiving hydrophilic colloid layer. Suitable antistatic layers are well known and they can be applied to the support using any convenient method suitable for this purpose. Typical antistatic layers include poly(vinyl alcohol) compositions having alkali metal halides and matting agents as described in U.S. Pat. No. 3,437,484.

Electrographic copy processes that are used to provide transparencies are well known and have been used extensively in recent years. A typical process used in practicing this invention employs an electrophotographic element comprising a support material bearing a coating of a normally insulating material. The electrical resistance of the insulating material, moreover, varies with the amount of incident actinic radiation it receives during an imagewise exposure. The element, commonly termed a photoconductive element, is first given a uniform surface charge, generally in the dark, after a suitable period of dark adaptation. It is then exposed to a pattern of actinic radiation which has the effect of differentially reducing the potential of the surface charge in accordance with the relative energy contained in various parts of the radiation pattern. The differential surface charge or electrostatic latent image remaining on the electrophotographic element is then transferred to an image-receiving hydrophilic colloid layer of a substantially transparent receiving element, as described previously. The transfer operation is well known in the art and is described in U.S. Pat. No. 2,825,814.

The transfer of the electrostatic image is generally carried out by contacting the insulating surface of the exposed photoconductive element with the surface of the image-receiving hydrophilic colloid layer. An electric field is established between these surfaces and the electrostatic charge is transferred to the image-receiving hydrophilic colloid layer where it is trapped. The transferred latent image is then made visible by contacting the surface with fusible toner particles. Such toner, whether contained in an insulating liquid or on a dry carrier, can be deposited on the receiving element either in the areas where there is an electrostatic charge or in the areas where the charge is absent.

Alternatively, prior to transfer, the electrostatic latent image can be developed directly on the photoconductive element in the same manner set forth above. The developed image can be transferred to the image-receiving hydrophilic colloid layer of the transparent receiving element by contacting the two surfaces and applying an electrical potential between them.

As previously indicated, the toned image employed comprises particles of a fusible, typically resinous, material that is fixed to the image-receiving layer of the transparent receiver element by the application of heat. The toned image-bearing layer is brought into contact with a heated fuser surface, such as a fuser roll, where heat is applied to soften the toner particles, thus fusing the image to the image-receiver element.

The temperature of the fuser surface can vary widely depending on such factors as the type of toner employed and the duration of contact between the hydrophilic colloid layer and the fuser surface. In general, a temperature in the range from about 320° F. (160° C.) to about 400° F. (204° C.) can be typically employed. Such temperature is preferably in the range from about 340° F. (171° C.) to about 375° F. (191° C.).

Typical fuser surfaces are described in *Product Licensing Index,* Vol. 99, July 1972, Item 9944, pages 72–73 and *Research Disclosure,* Vol. 167, March 1978, Item 16730, pages 76–77. The surface of the fuser roll, moreover, is typically coated with a release liquid to inhibit transfer of toner particles onto the roll during fusing. Such coating can be accomplished, for example, by contacting the roll with a wick that is soaked with the release liquid and extends across the length of the roll. A large number of known release liquids are commercially available and suitable for this purpose. Silicon-containing release liquids are widely used but any of the wide variety of release liquids available can be used in practicing this invention. For example, a series of silicone glycol copolymer liquids as well as an alkylaryl silicone liquid, a chlorophenylmethyl silicone liquid, a dimethyl silicone liquid and a fluorosilicone liquid are commercially available from Dow Corning Company. Additional useful materials include poly(vinylidene fluoride) liquids, polymonochlorotrifluoroethylene liquids, hexafluoropropylene vinylidene fluoride copolymers, perfluoroalkyl polyethers (available under such names as Fomblyn and Krytox, sold by Montecatini-Edison and DuPont, respectively), fluoroalkyl esters, block copolymers of dimethyl siloxane with a variety of materials such as bisphenol A, tetramethylspirobi(indan)diol and the like. Of course, other release agents exhibiting good thermal stability are also useful.

Fusible toner particles that are suitable for forming a visible toned image on the image-receiving element can comprise a variety of known, mostly resinous, materials including natural resins and synthetic resins. Examples of useful natural resins are balsam resins, colophony, and shellac. Modified natural resins can also be used, examples of which are colophony-modified phenol resins and other resins listed below with a large proportion of colophony. Suitable synthetic resins are, for example, polymers, such as certain polycarbonate resins described in *Product Licensing Index,* Vol. 84, pages 69–70, April 1971; vinyl polymers and copolymers including poly(vinyl chloride), poly(vinylidene chloride), poly(vinyl acetate), poly(vinyl acetals), poly(vinyl ether), poly(acrylic) and poly(methacrylic) esters, maleinate resins and colophony-mixed esters of higher alcohols; aldehyde resins, ketone resins; polyurethanes; etc. Moreover, chlorinated rubber and polyolefins, such as various polyethylenes, polypropylenes, polyisobutylenes, are also suitable. Also suitable toner materials are phenol-formaldehyde resins, including modified phenol formaldehyde condensates and the butyral/phenol-formaldehyde mixtures as described in U.S. Pat. No. 2,753,308; polyamides as described, for example, in U.S. Pat. No. 3,345,294 and in U.S. Defensive Publication No. T875,005; crosslinked-resins such as described, for example, in U.S. Pat. No. 3,579,451 and U.S. Pat. No. 3,938,992; vinyl pyridines such as described, for example, in German Pat. No. 2,438,848; silicone oil-coated toners as described, for example, in U.S. Pat. No. 3,652,315; metal resinate toners as described for example, in U.S. Pat. No. 3,165,420; polycarbonates as described, for example, in U.S. Pat. No. 3,694,359; pigmented shellac toners as described, for example, in U.S. Pat. No. 3,090,755; and polyesters, e.g., phthalate, terephthalic and isophthalic polyesters as well as those described in U.S. Pat. No. 3,681,106, and styrene-containing resins such as described in U.S. Pat. No. 3,944,493 (issued Mar. 16, 1976 to Jadwin et al.), in particular, toner A described in column 10, example 1, and U.S. Pat. No. 3,938,992 (issued Feb. 17, 1976 to Jadwin et al.).

The following examples are included for a further understanding of the invention.

EXAMPLE 1

A 4 mil thick biaxially oriented transparent poly(ethylene terephthalate)film support was coated on both sides with an adhesion-promoting sublayer. A gelatin layer was coated over one of the sublayers. The gelatin layer comprised, by weight, 83.5% gelatin, 12.7% saponin, 0.01% gelatin hardener, 1.26% poly(methyl methacrylate)beads as matte agent, and 2.53% biostatic agent. An antistatic layer of the type described in U.S. Pat. No. 3,437,484 was coated over the second subbing layer on the side of the support opposite the gelatin layer.

Transparent receiving elements resulting from the above coating operations were used in a copy process in a high speed electrostatic copier. The copier included as a photoconductive element a continuous belt comprised of a film support, an electrically conductive layer on the film support, and an outermost photoconductive layer on the electrically conductive layer comprising an aggregate photoconductive composition such as described in Light U.S. Pat. No. 3,615,414. The photoconductive belt was given a uniform negative electrostatic charge in the range from about 300 to 600 volts and thereafter exposed to a document original to dissipate the uniform charge in light-struck regions, thereby forming an electrostatic image. Next, an electrographic developing composition comprising cross-linked styrene-containing fusible toner particles such as described either in Jadwin et al U.S. Pat. No. 3,944,493, column 10, example 1, toner A, or in Jadwin et al. U.S. Pat. No. 3,938,992 was contacted with the electrostatic image to form a toned image of fusible toner particles. The gelatin layer of the transparency was placed in contact with the toned image-pattern on the photoconductive belt. The transparency was given an electrostatic charge of such a polarity and strength as to transfer the toned image onto the gelatin layer. Thereafter, the toned image-bearing gelatin layer was contacted with a fuser roller heated to a temperature of about 340° F. (171° C.) coated with a silicon-containing release liquid available commercially as DC-200 Fuser Oil (sold by the Dow Corning Corporation).

The resulting elements with fused image were projected onto a viewing screen using an overhead projector such as the Five "O" Eighty Eight Overhead Projector sold by the 3M Corporation or the Apollo Overhead Projector sold by the American Optical Corporation. No release liquid was displayed in the non-toned regions of the projected image.

EXAMPLE 2

Seven transparencies were prepared by the procedure of Example 1 except that the fuser roller was heated to a temperature of about 375° F. To illustrate that transparencies formed in accordance with the present invention exhibit good resistance to abrasion in toned areas, a rub resistance test was conducted with these seven transparencies.

This rub test consists of wrapping four layers of a dry two-ply white facial tissue over one two-inch side of a 211 Artgum eraser (1"×7"×2"). The tissue wrapped eraser is rubbed on one-inch square medium to high density solid toned areas using moderate hand pressure in a circular pattern two inches in diameter. Five circular revolutions are made. After rubbing, the tissue and copy are observed and a rub resistance rating given the copy according to the following standards:

Poor—the image on the copy is partly or completely removed.

Fair—a heavy amount of toner is on the tissue, but there is very little lightening of the toned area, and only a small amount of toner smears onto the non-toned background.

Good—a light amount of toner is on the tissue and there is no noticeable lightening of the toned area nor any noticeable smear on the background.

Very Good—an extremely light amount of toner is on the tissue and there is no lightening of the toned area nor smear on the background.

Excellent—there is no toner on the tissue, no lightening of the toned area, nor smear on the background.

Of the seven transparencies, two were given a rating of very good, four were good, and one was fair.

EXAMPLE 3

A paper towel was moistened with water. Selected toner areas of the seven transparencies of Example 2 were lightly rubbed with the moistened towel. Toner in the rubbed areas was readily removed, exposing transparent, undamaged background.

Similar results were achieved when the gelatin layer was replaced by a hardened poly(vinyl alcohol) layer.

The invention has been described with particular reference to certain preferred embodiments, however, it will be understood that variations and modifications can be effected within the spirit and scope of the invention.

What is claimed is:

1. An electrographic copy process for forming a projection-viewable transparency comprising a. forming a toned image of fusible toner particles on an image-receiving hydrophilic colloid layer of a substantially transparent image receiver element, and b. fusing said toner particles to said hydrophilic colloid layer by contacting said toned image-bearing layer with a heated fuser surface coated with a release liquid which inhibits offsetting of said toner particles onto said fuser surface.

2. The process of claim 1 wherein said hydrophilic colloid is a proteinaceous hydrophilic colloid.

3. The process of claim 1 wherein said hydrophilic colloid is gelatin.

4. The process of claim 1 wherein said hydrophilic colloid is a synthetic hydrophilic colloid.

5. The process of claim 1 wherein said hydrophilic colloid is a poly(vinyl alcohol).

6. The process of claim 1 wherein said release liquid is a silicon-containing release liquid.

7. The process of claim 6 wherein said hydrophilic colloid is a proteinaceous hydrophilic colloid.

8. The process of claim 6 wherein said hydrophilic colloid is gelatin.

9. The process of claim 6 wherein said hydrophilic colloid is a synthetic hydrophilic colloid.

10. The process of claim 6 wherein said hydrophilic colloid is a poly(vinyl alcohol).

11. The process of claim 6 wherein said toner particles comprise a styrene-containing resin.

12. An electrographic copy process for forming a projection-viewable transparency comprising a. forming a toned image of fusible toner particles on an image-receiving hydrophilic colloid layer of a substantially transparent image receiver element, and b. fusing said toner particles to said hydrophilic colloid layer by contacting said toned image-bearing layer with a surface of a heated fuser roller coated with a silicon-containing release liquid which inhibits offsetting of said toner particles onto said fuser surface.

13. The process of claim 12 wherein said fuser roller is heated to a temperature in the range from about 320° F. to about 400° F.

14. The process of claim 13 wherein said temperature is in the range from about 340° F. to about 375° F.

15. The process of claim 12 wherein said image receiver element comprises a polyester film support.

16. The process of claim 12 wherein said image receiver element comprises a polyethylene terephthalate film support.

17. The process of claim 12 wherein said image receiver element comprises an antistatic layer on the surface opposite to said hydrophilic colloid layer.

18. The process of claim 17 wherein said antistatic layer contains a matte agent.

19. A projection-viewable transparency prepared according to the process of claim 1.

20. A projection-viewable transparency prepared according to the process of claim 3.

21. A projection-viewable transparency prepared according to the process of claim 4.

22. A projection-viewable transparency prepared according to the process of claim 12.

* * * * *